United States Patent [19]

Meyer et al.

[11] Patent Number: 4,863,487

[45] Date of Patent: Sep. 5, 1989

[54] HYDROCARBON FUEL DETERGENT

[75] Inventors: George R. Meyer, Missouri City; Walter R. Lyons, Jr., Rosenberg, both of Tex.

[73] Assignee: Nalco Chemical Company, Naperville, Ill.

[21] Appl. No.: 43,736

[22] Filed: Apr. 29, 1987

[51] Int. Cl.[4] ..... C10L 1/18; C10L 1/22

[52] U.S. Cl. ..... 44/63; 44/71; 252/51.5 A; 525/380; 525/382; 525/386; 526/242

[58] Field of Search ..... 44/63, 71, 62, 78, 58; 252/51.5 A; 548/546; 525/380, 382, 386; 526/272

[56] References Cited

U.S. PATENT DOCUMENTS

| | | | |
|---|---|---|---|
| 3,172,892 | 3/1965 | LeSuer et al. | 260/326.5 |
| 3,202,678 | 8/1965 | Stuart et al. | 260/326.5 |
| 3,223,495 | 12/1965 | Calvino et al. | 44/71 |
| 3,438,757 | 4/1969 | Honnen et al. | 44/58 |
| 3,443,918 | 5/1969 | Kautsky | 44/63 |
| 3,676,089 | 7/1972 | Morris | 44/62 |
| 3,920,698 | 11/1975 | Haemmerle et al. | 44/63 |
| 3,980,448 | 9/1976 | Haemmerle et al. | 44/63 |
| 4,046,521 | 9/1977 | Bessler et al. | 44/62 |
| 4,098,585 | 7/1978 | Vartanian et al. | 44/63 |
| 4,240,803 | 12/1980 | Andress, Jr. | 44/63 |
| 4,375,974 | 3/1983 | Maldonado et al. | 44/63 |
| 4,409,000 | 10/1983 | LeSuer | 44/70 |
| 4,648,885 | 3/1987 | Reid | 44/63 |
| 4,652,273 | 3/1987 | Maldonado et al. | 44/63 |

*Primary Examiner*—William R. Dixon, Jr.
*Assistant Examiner*—Margaret B. Medley
*Attorney, Agent, or Firm*—Joan I. Norek; John G. Premo; Donald G. Epple

[57] ABSTRACT

Detergents for hydrocarbon fuels, and hydrocarbon fuels containing detergents are provided wherein the detergent is comprised of an alkenylsuccinimide prepared by reacting an alkenylsuccinic acid or anhydride with a mixture of amines. The alkenyl substituent is substantially derived from an olefin having a carbon chain or from 8 to 10 carbons or mixtures thereof.

8 Claims, No Drawings

HYDROCARBON FUEL DETERGENT

TECHNICAL FIELD OF THE INVENTION

The invention is in the technical field of detergents for hydrocarbon fuel compositions such as gasoline fuel, jet fuels, heating oils, and the like, and detergent-containing hydrocarbon fuel compositions.

BACKGROUND OF THE INVENTION

Hydrocarbon combustion fuels tend to leave deposits at various areas of the power systems in which they are employed, which deposits interfere with the flow of fuel-air mixtures, and the efficiency of many engine parts. Additives generally called detergents are used to decrease or remove such deposits. For instance, automotive fuel detergents are used to prevent and remove deposit fouling in both carbureted and port fuel injected engines. Port fuel injectors are generally extremely precise in construction, generally allowing a 0.05 millimeter clearance between the pintle and seat, and in this vicinity deposits have an serious deletorious effect. It is believed that a deposit layer of as little as five microns can cause a 25 percent reduction in fuel flow, and a perceivable loss of drivability occurs at a flow reduction of even 10 percent. Port fuel injector fouling can result in decreased fuel economy, power loss and hesitation, misfiring, rough idling, and poor startability. Carbureted systems are also detrimentally affected by deposits in critical areas such as in the regions of venturi and throttle plate. Deposit formations in carbureted systems also result in operability problems.

A desirable hydrocarbon fuel detergent should be effective for both the functions of precluding or diminishing deposit formation and cleaning up existing deposits. It should provide corrosion protection, inhibiting corrosion in fuel transfer and storage systems and in the engines where the fuel is used. It should be compatible with demulsifiers or fuel dehazers for prevention of fuel haze and harmful emulsions so that the employment of the detergent does not diminish a fuel's ability to shed water. It should be compatible with a wide variety of materials employed in the construction of fuel transfer and storage systems and engine components. In addition, it should be cost efficient. These and other objects of the present invention are discussed in more detail below.

DISCLOSURE OF THE INVENTION

The present invention provides a detergent for hydrocarbon fuel compositions, and hydrocarbon fuel compositions containing an effective amount of the detergent. The detergent of the present invention is a mixture of certain N-substituted imides derived from adducts of maleic anhydride and certain olefins. Olefins, unsaturated open-chain hydrocarbons, react by the Alder or "ene" reaction with maleic anhydride or acids to form alkenylsuccinic anhydrides or acids, from which can be formed corresponding N-substituted imides by further reaction of the intermediate with amines. The olefins and amines utilized in the formation of the detergent of the present invention are described in detail below. The term detergent as used herein means an additive with both cleansing and dispersant activity.

PREFERRED EMBODIMENTS OF THE INVENTION

The alkenylsuccinic anhydride intermediate can be prepared by the known reaction between olefins and maleic anhydride whereupon the ring structure of the anhydride becomes substituted with the alkenyl of the olefin with the loss of the maleic anhydride carbon-to-carbon unsaturation. The reaction can proceed to form a one-to-one maleic anhydride/olefin adduct by the following reaction path:

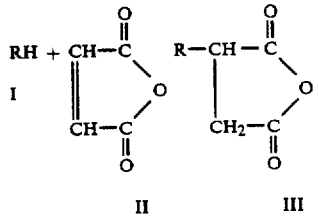

In the above formulas R is the alkenyl radical of the RH olefin. The reaction can also proceed to form a two-to-one maleic anhydride/olefin adduct, although it is believed that when substantially equal molar ratios of maleic anhydride and olefin are reacted the predominant product species (at least about 90 weight percent) will be the one-to-one adduct, i.e., the simple alkenylsuccinic anhydride of the Formula III above. The "ene" reaction occurs without loss of the olefin unsaturation, which instead is shifted, and hence such carbon-to-carbon unsaturation remains available for reaction again with the maleic anhydride species to form the two-to-one adduct.

The intermediate alkenylsuccinic anhydride used for the preparation of the detergent of the present invention may be a one-to-one or two-to-one maleic anhydride/olefin adduct or mixtures thereof. It is preferred that substantially all of the maleic anhydride be converted to the corresponding succinic species.

The alkenyl substituent is any olefin having a carbon chain of from 8 to 30 carbon atoms or mixtures thereof, or may be derived from a mixture of olefins most broadly defined as being substantially comprised of olefins having chain lengths of 10 to 30 carbon atoms. By substantially is herein meant that at least 90 weight percent, and preferably at least 95 weight percent of the olefins have carbon chain lengths within the range of from 10 to 30 carbon atoms. In more preferred embodiment the alkenyl substituent is derived from a mixture of olefins both substantially comprised of olefins having chain lengths of from 10 to 30 carbon atoms and further comprised of at least 75 weight percent of olefins having chain lengths of from 12 to 26 carbon atoms. In another more preferred embodiment the alkenyl substituent is derived from a mixture of olefins both substantially comprised of olefins having chain lengths of from 10 to 30 carbon atoms and further comprised of at least 40 weight percent of olefins having chain lengths of from 12 to 1.carbon atoms.

In more preferred embodiments the alkenyl substituent is derived from a mixture of olefins having one or more of the following specifications as to chain length distribution:

(1) substantially all within the 10 to 30 carbon atom range; and at least 85 wt. percent within the 12 to 26 carbon atom range.

(2) substantially all within the 10 to 30 carbon atom range; and at least 50 wt. percent within the 12 to 18 carbon atom range.

In a preferred and highly advantageous embodiment, the alkenyl substituent is derived from mixtures known as olefin "bottoms", i.e., coproducts from other manufacturing procedures, which is extremely advantageous because of its low cost. Such bottoms can be described by the range of chain length distributions and other parameters as set forth in Tables I, II, III and IV below.

TABLE I

| Olefin (by chain length) | Weight Percentage Based on Total Olefin (At Least 90 Weight Percent of Total Olefin Within the $C_{10}$ to $C_{30}$ Range |
|---|---|
| 10 carbons | 0 to 2.0 |
| 12 carbons | 0 to 25.0 |
| 14 carbons | 1.5 to 20 |
| 16 carbons | 15 to 30 |
| 18 carbons | 8 to 30 |
| 20 carbons | 6 to 15 |
| 22 carbons | 5 to 12 |
| 24 carbons | 5 to 12 |
| 26 carbons | 3 to 8 |
| 28 carbons | 2 to 5 |
| 30 carbons | 1.5 to 5 |
| greater than 30 carbons | 2 to 6 |

TABLE II

| Olefin type (NMR analysis) | Mole Percent based on total Olefin |
|---|---|
| vinyl | 20 to 35 |
| Internal | 22 to 34 |
| branched | 32 to 60 |

TABLE III

| Ingredient | Weight Percent based on total bottoms |
|---|---|
| olefin | 75 minimum |
| alcohol | 2 maximum |
| paraffin | 25 maximum |

TABLE IV

| Parameter | Range |
|---|---|
| iodine value ($cgI_2/g$) | 60 minimum |
| peroxide (ppm) | 20 maximum |
| hydroxy value (wt. %) | 5 maximum |

Such olefin bottoms may contain an amount of paraffin which is a nonreactive impurity. Olefin mixtures without any paraffin content may of course be utilized in the preparation of the detergents of the present invention, although some paraffin content is typical of the olefin bottoms presently commercially available at low cost.

Olefin bottoms containing alcohol, or other species reactive to the anhydride, will compete with the amines used to formulate the detergent of the present invention, causing the formation of side-products, such as esters or half esters formed in alcohol, and thus should be tolerated in the bottoms only to the extent cost justified.

As noted above, the olefin used to prepare the detergent of the present invention may be an olefin having a single chain length within the 8 to 30 carbon range, for instance of $C_8$ or $C_{12}$ or $C_{18}$ or $C_{26}$ olefin or the like. It is believed however that a mixture of olefins, such as the olefin bottoms described above, will provide a detergent that is effective in a broad range of hydrocarbon fuel compositions. Even for a single type of fuel, for instance gasoline, which varies in composition from brand to brand, it is believed that a detergent formed with a mixture will provide a more uniform effectiveness regardless of the composition variations than one formed of a single olefin or mixtures of just a few olefins.

The amines used to prepare the detergent of the present invention are certain mixtures of aliphatic and heterocylic polyamines as set forth in the following Table V.

TABLE V

| Amine | Percentage by Weight |
|---|---|
| aminoethylethanolamine | 5 to 70 |
| aminoethylpiperazine | 5 to 30 |
| triethylenetetramine | 0 to 25 |
| hydroxyethylpiperazine | 0 to 20 |
| diethylenetriamine | 0 to 10 |
| higher oligomers of the above amines | 10 to 85 |

The amine mixture for cost purposes may be amine bottoms. In preferred embodiment the amine species in the amine mixture used to prepare the detergent of the present invention is comprised at least of 90 weight percent, and more preferably 95 weight percent, of the amine species set forth in Table V above at the distribution ranges set forth therein. In preferred embodiment at least 90 weight percent, and more preferably 95 weight percent, of the amine species in the amine mixture used to prepare the detergent of the present invention are those set forth in Table VI below at the distribution ranges set forth therein.

TABLE VI

| Amine | Percentage by Weight |
|---|---|
| aminoethylethanolamine | 15 to 50 |
| aminoethylpiperazine | 12 to 16 |
| triethylenetetramine | 2 to 10 |
| hydroxyethylpiperazine | 1 to 10 |
| diethylenetriamine | 0.5 to 3 |
| higher oligomers of the above amines | 25 to 45 |

By the term "oligomers of the above amines" is meant for instance the di-, tri-, or higher forms of the amines specified.

In general, the detergent of the present invention may be prepared by first reacting maleic anhydride and the olefin in a solventless system at elevated temperatures, forming alkenyl succinic anhydrides, and then reacting of such anhydrides with the mixture of aliphatic and heterocyclic poly amines, to form the imides. The second reaction is preferably performed in a suitable solvent, such as toluene or heavy aromatic solvent. The reaction between the olefin and maleic anhydride is conducted with a molar ratio of olefin to maleic anhydride of from about 0.8 to 2.2 moles of olefin per mole of maleic anhydride, although as one exceeds about 1.2 moles of olefin per mole of maleic anhydride one is forcing the formation of the 2.1 maleic anhydride to olefin adduct. Since it is desirable to convert all the maleic anhydride to the succinic species, it is preferred that 0.8 to 1.2 moles of olefin per mole of maleic anhydride be used. The reaction between the alkenylsuccinic anhydride and the amines should be conducted with from about 0.8 to 1.5 moles of amine per mole of anhydride, and preferably about 0.8 to 1.2 moles of amine per mole of anhydride. Although the reaction of the alkenylsuccinic anhydrides with amines can produce esters and half esters, the reaction conditions should be controlled to produce a detergent comprised of at least 80 weight percent of the N-substituted imides, and in more preferred embodiment at least 90 weight percent of the N-substituted imides.

The detergent (as actives) of the present invention is effective in hydrocarbon fuel compositions at a level of from about 1.2 to 50 ptb and in preferred embodiment at a level of from about 1.2 to about 30 ptb. Higher amounts are generally unnecessary for effectiveness and minimization of additives in hydrocarbon fuels is generally desirable. As will be described in the Examples below, the typical concentration of the detergent as a diluted solution that will provide "keep-clean" performance in an automotive vehicle is 7 to 11 ptb for carbureted systems and 10 to 30 ptb for port fuel injected systems. For "clean-up" performance the concentrations may be increased to 20 to 50 ptb in carbureted systems and 20 to 60 ptb in port fuel injected systems. Since the detergent solutions are prepared with about 50 weight percent added solvent and the starting materials contain about 4.5 percent paraffin, and the solutions are further generally diluted by the addition of 2 weight percent dehazer, the actives in such solutions are about 46.5 weight percent of the detergent solutions.

Reaction conditions should be controlled so that the residuals, i.e., unreacted reactants, do not exceed the following: 8 wt. percent alkanes; 16 wt. percent alkenes; 1.0 wt. percent maleic anhydride; 2.0 wt. percent amines.

It is convenient to supply the detergent of the present invention as a 50 to 75 wt. percent solution in a suitable solvent, such as a heavy aromatic naptha or toluene, xylene, or the like.

The olefin composition that is designated herein as the $C_{12}$ to $C_{30}$ mixture ("$C_{12-30}$ and that used in the Examples below was a commercially available product and was comprised of 14.8 weight percent paraffins and 85.2 weight percent olefins. The carbon chain length distribution by weight percent, determined by VPC, was as follows:

TABLE VII

| Chain Length | Weight Percentage |
|---|---|
| $C_{10}$ | 1.7 |
| $C_{12}$ | 19.7 |
| $C_{14}$ | 15.3 |
| $C_{16}$ | 19.6 |
| $C_{18}$ | 9.9 |
| $C_{20}$ | 8.0 |
| $C_{22}$ | 7.0 |
| $C_{24}$ | 6.4 |
| $C_{26}$ | 4.6 |
| $C_{28}$ | 3.2 |
| $C_{30}$ | 2.0 |
| greater than $C_{30}$ | 2.6 |

As indicated by the above, 97.4 weight percent of this composition was within the $C_{10-30}$ range and 64 weight percent was within the narrower $C_{12-18}$ range. This sample also had the following specifications: hydroxy value (wt.%) of 0.08; iodine value ($cgI_2/g$) of 81.6; peroxide (ppm) of 17; and moisture content (wt.%) of 0.002. By NMR analysis it was determined that the olefin isomers were distributed as follows:

26.8 mole percent vinyl
28.2 mole percent internal
45.0 mole percent branched

The olefin composition that is designated herein as a $C_{14}$ to $C_{30}$ mixture ("$C_{14-30}$ olefin") and used in the Examples below was a commercially available product comprised of 2.6 weight percent alcohols, 13.0 weight percent paraffins, and 84.5 weight percent olefins. The carbon chain length distribution, by weight percent, determined by VPC, was as follows.

TABLE VIII

| Chain Length | Weight Percentage |
|---|---|
| $C_{14}$ | 2.2 |
| $C_{16}$ | 25.3 |
| $C_{18}$ | 24.9 |
| $C_{20}$ | 11.9 |
| $C_{22}$ | 9.2 |
| $C_{24}$ | 9.3 |
| $C_{26}$ | 5.5 |
| $C_{28}$ | 4.1 |
| $C_{30}$ | 3.3 |
| greater than $C_{30}$ | 4.3 |

As indicated by the above, 95.7 weight percent of this sample was within the $C_{12-30}$ range, and 52.4 weight percent was within the $C_{12}$-18 range. This sample also had the following specifications: hydroxy value (wt.%) of 0.42; iodine value ($cgI_2/g$) of 82.5; peroxide (ppm) of less than 1; and moisture content (wt.%) of 0.03. By NMR it was determined that the olefin isomers were distributed as follows:

29.4 mole percent vinyl
20.4 mole percent internal
50.2 mole percent branched

The amine mixtures designated hereinafter as Amine-A and Amine-B have the following compositions by weight:

TABLE IX

| Amine | Weight Percentages Amine-A | Amine-B |
|---|---|---|
| aminoethylethanolamine | 10–20 | 30–60 |
| aminoethylpiperazine | 10–20 | 8–14 |
| triethylenetetramine | — | 5–15 |
| hydroxyethylpiperazine | 2–10 | 1–10 |
| diethylenetriamine | 0–2 | 1–5 |
| higher oligomers of the above amines | 60–70 | 15–40 |

The $C_{12-30}$ olefin, $C_{14-30}$ olefin, Amine-A, and Amine-B compositions described above are all "bottoms", compositions formed as coproducts or side products from commercial productions and hence are generally available at low cost.

Use levels are given herein in terms of "ptb" which abbreviation stands for "pounds per thousand barrels". A ptb in gasoline is equivalent to about 4 ppm (parts per million).

The dehazer used herein is a commercial dehazer for hydrocarbon fuel compositions of the polyglycolated alkyl phenol/formaldehyde resin type.

EXAMPLE 1

Into a pilot plant reactor we.-e charged 9.8 parts by weight of maleic anhydride and 30.2 parts by weight of the $C_{12-30}$ olefin described above (containing about 25.7 parts by weight olefin) and with agitation heated at 150° C. for about 15 hours and then the temperature was raised to 250° C. and held at the temperature for about 45 minutes, after which period I.R. analysis indicated the absence of maleic anhydride carbon-to-carbon unsaturation. The reaction mixture as cooled to 125° C. and admixed with 50 parts by weight of an aromatic naptha solvent and 10 parts by weight of Amine-B described above. The reaction mixture was held at 125° C. for about 2.5 hours and then heated to 135° C. for about 1.0 hour, after which it was filtered.

EXAMPLE 2

Into a 3 liter three-necked flask equipped with a mechanical stirrer, condenser, thermometer and addition funnel, was charged 98 grams (1 mole) of maleic anhydride and 300 grams (about 1 mole) of $C_{12-30}$ olefin described above. The mixture was heated to 250° C. and held at this temperature for 1.0 hours under constant agitation, and then cooled to ambient room temperature. The reaction product was determined by infra red spectrometry to contain no maleic anhydride carbon-to-carbon unsaturation. This reaction product was then heated to 135° C. and then 497.5 grams of aromatic naptha and 99.5 grams of Amine-B, described above, were added under agitation. The mixture was then stirred at 135° C. for 1 hour and then cooled to ambient room temperature, filtered, and stored for future use. The final product weighed 953 grams or 95.8 wt. percent of theoretical yield. By infra red spectrometry it was determined that the reaction was complete.

EXAMPLE 3

To 785 grams of the final reaction product prepared as described in Example 2 was added 16 grams of the commercial motor fuel dehazer described above to form a composition containing 2 weight percent of a commercial dehazer for motor fuel. The actives of this final detergent solution is about 46.5 weight percent.

EXAMPLE 4

A mixture of 80 g. of an olefin-substituted succinic anhydride prepared as described above in Example 2, 20 g. of the Amine-A described above, and 100 grams toluene were combined and heated to reflux temperature in a three-neck flask equipped with mechanical stirring and a Dean-Stark trap. The mixture was stirred and heated at reflux temperature for 8 hours, during which time 3.8 ml. of water was collected in the trap. After the 8 hours of reflux, the mixture was cooled with stirring to ambient room temperature and stored for future use. This reaction product was determined to have a specific gravity of 0.92 g/ml as prepared as a solution having 50 weight percent toluene.

EXAMPLE 5

A mixture of 80 grams of olefin-substituted succinic anhydride prepared as described above in Example 2, 20 grams of the Amine-B described above, and 100 grams of toluene were combined and refluxed in a 500 ml. three-necked flask equipped with a mechanical stirrer and a Dean-Stark trap for 5 hours, during which time 2.2 ml. of water was collected in the trap. An I.R. analysis indicated that the reaction was completed. The reaction product was cooled and stored for future use.

EXAMPLE 6

A mixture of 98 grams (1 mole) of maleic anhydride and 110 grams of $C_{14-30}$ olefin (described above) was placed into a 3-liter, 3-necked, round bottomed flask equipped with a mechanical stirrer, thermometer, addition funnel, and condenser. The mixture was heated to 192°-195° C. and 220 additional gram of the $C_{14-30}$ olefin was added at a temperature of from 194° to 202° C. as foaming permitted. The total 330 gram charge of the $C_{14-30}$ olefin contained about 279 grams olefin or about 1 mole. The temperature of the reaction mixture was slowly increased to 250° C. and held at that temperature for 2 hours, after which time I.R. analysis indicated that formation of the alkenyl succinic anhydride was completed. (I.R. analysis showed the absence of a peak at 835 $cm^{-1}$ indicating the absence of maleic anhydride carbon-to-carbon unsaturation.) The reaction mixture was cooled at 135° C. and 99.5 grams of Amine-B and 497.5 grams of heavy aromatic solvent (both described above) were added alternately in portions as permitted to avoid the temperature rising over 200° C. The reaction mixture was then held at 135° C. for 1 hour, after which time I.R. analysis indicated that the reaction was completed. The product was determined to have a detergency effectiveness commensurate to that formed using the $C_{12-30}$ olefin.

EXAMPLE 7

The procedure of Example 1 was repeated except the percentage of the amine was increased to provide a charge of reactants as follows, based on parts per weight: 9.8 parts maleic anhydride; 30.2 parts of the $C_{12-30}$ olefin; 17.1 parts of the Amine-B; and 56.8 parts of the aromatic naptha solvent.

CRC CARBURETOR DETERGENCY PERFORMANCE TEST PROCEDURE

The CRC Carburetor Detergency Performance Test is used to determine the efficiency of a motor fuel detergent in the prevention and removal of carburetor deposits. Deposits in the throttle body of a carburetor can affect its idle and low speed metering characteristics and thus have a deleterious influence on exhaust emissions, fuel consumption, and performance. The test is an accelerated method for investigating throttle body deposits, using a removable carburetor throttle body sleeve. A polished, tared aluminum sleeve is fitted into the throat of a carburetor on a standard test engine, which is then operated on a stand, under cylic conditions, between idle and medium cruise for a period of 20 hours, after which the sleeve is removed and reweighed to determine weight of the deposits thereon. To accelerate deposit formation, a controlled amount of blowby, induced by enlarging the gaps of the compression rings, is passed into the top of the carburetor mixed with heated intake air, and in addition full EGR is applied during the cruise cycle. To determine a detergent's efficiency in keeping the throttle body clean, comparative tests are conducted between an unadditized fuel and that same fuel with a detergent added, using in each instance a freshly polished sleeve. To determine a detergent's efficiency in cleaning up deposits already formed on the throttle body, the procedure is first run with an unadditized base fuel for 20 hours, the deposit weight determined, and then the soiled sleeve is reinstalled for a second 20 hours run using a detergent-containing fuel.

EXAMPLE 8

CRC Keep-Clean test

Utilizing the "keep-clean" procedure of the CRC Carburetor Detergency Performance Test described above, the detergent efficiency of the detergent solution prepared as described above in Example 4 was compared to that of four commercial gasoline detergents, designated hereinafter as Commercial a, b, c and d. All were tested at a level of 7 ptb (pounds per thousand barrels), as supplied, which for the succinimide composition of the present invention is about one-half that level of actives. "Baselines" or blanks, i.e., the same fuel without detergent additive, were also run at the beginning, middle, and end of the test series, and variations between these blanks (28.2±2.9 mg.) indicated about a 10% variability in the data precision. The engine used was a 200 CID straight-six automotive engine. A level of 7 ptb is considered minimal carburetor protection, and at this level the succinimide composition of the present invention was shown to perform to commercially acceptable levels, as indicated by the test data, given in weight percentage of reduction of deposits relative to that of the baselines or blanks, set forth in Table X below.

TABLE X

| CRC Keep-Clean Test at 7 ptb | |
|---|---|
| Detergent | Percent Reduction in Deposits Relative to Average Baseline |
| Commercial a | 23.8 |
| Commercial b | 11.3 |
| Commercial c | 40.8 |
| Commercial d | 2.5 |
| Example 4 | 49.6 |

EXAMPLE 9

The CRC Carburetor Detergency Performance Test, keep clean procedure, was employed to test three detergents of the present invention and ten commercial gasoline detergents. The test was conducted as described in Example 8 above except that all detergents were tested at a level of 20 ptb as supplied. The commercial detergents are designated "Commercial a" and "c" through "k", Commercial a through d being the same commercial detergents as those designated in Example 8. The three detergents of the present invention are those solutions prepared as described in Examples 4, 5 and 7 above. The baseline variations were commensurate with that of Example 8. The results of this test are set forth in Table XI below.

TABLE XI

| CRC Keep-Clean Test at 20 ptb | |
|---|---|
| Detergent | Percent Reduction in Deposits Relative to Average Baseline |
| Commercials | |
| a | 28.5 |
| c | 95.7 |
| d | 11.2 |
| e | 95.9 |
| f | 96.7 |
| g | 96.3 |
| h | 95.7 |
| i | 96.8 |
| j | 49.6 |
| k | 96.1 |
| Example 4 | 95.4 |
| Example 5 | 98.3 |
| Example 5 | 91.8 |
| Example 7 | 82.0 |

EXAMPLE 10

CRC Clean-up Test

Utilizing the "clean-up" procedure of the CRC Carburetor Detergency Performance Test described above, the detergency performance in removing deposits previously formed of a detergent of the present invention using the detergent solution prepared as described in Example 3 above was shown. The detergent solution was tested at concentration levels of from 20 to 50 ptb in an unleaded commercial gasoline without detergent additives, which same gasoline was first cycled for the standard 20 hour period to provide a fouled sleeve for use in the subsequent test of the cleanup performance. At the low detergent solution level of 20 ptb the detergent removed about 15 percent of the deposits previously formed. At a detergent solution level of 30 ptb about 50 percent of the deposits were removed. At a detergent solution level of 50 ptb about 90 percent of the previously preformed deposits were removed after the standard 20 hour cycling with the detergent additized gasoline.

EXAMPLE 11

Port Fuel Injector Detergency Test

To test the detergency efficiency in vehicles equipped with multiport fuel injected engines, automobiles equipped with standard 5.0 liter multiport fuel injected engines are employed in driving cycles on a five mile oval track. Each driving cycle consists of a nominal 15 minutes operation at 55 mph road load conditions, followed by a controlled 45 minutes hot soak at approximately 80° F. ambient temperature. After sufficient cycling the injectors are removed from the vehicle and evaluated as to change in flow. Each test is run in triplicate using three vehicles and the result reported as the average of the triplicate set. Variations between identical triplicate sets has been shown to be normally less than ±1 percent. A detergent of the present invention, the detergent solution prepared as described in Example 3 above, was tested as to its cleanup efficiency at a detergent solution level of 60 ptb. A fuel/air flow reduction of 10 percent is considered as indicative of port injector fouling, and thus all vehicles were cycled until at least a 10 percent reduction in flow occurred. Thereafter using a triplicate of vehicles with fouled port injectors, on a vehicle average, cycling with one tank of gasoline having 60 ptb of the detergent solution reduced the air/fuel flow reduction to 6 percent. With two tanks of additized gasoline, the air/fuel flow reduction was reduced to 5 percent. With three tanks of additized gasoline, the air/fuel flow reduction was further reduced to 3 percent.

EXAMPLE 12

NACE Corrosion Inhibition Test

The standard NACE TM-01-72 spindle procedure was utilized to determine the detergent of the present invention's ability to inhibit corrosion in fuel transfer and storage systems as well as in vehicles. A detergent solution prepared as described in Example 3 above was tested in a wide variety of commercial gasolines, all of which were depolarized prior to use. The tests showed that at a 15 ptb detergent solution level was sufficient to provide a NACE rating of "A" indicating zero rust, while the same gasoline without the detergent generally received an "E" NACE rating indicating 75 to 100 percent rust.

EXAMPLE 13

Gasoline Water Tolerance

The detergent solution prepared as described in Example 3, which includes 2 weight percent of a commercial dehazer, has been shown to create no significant change in the water tolerance of six commercial gasolines when added at concentrations from moderate (20 ptb) to high (50 ptb) using ASTM D1094 Interface Ratings. Each of the six fuels received a rating of 1, while each additized with 30 ptb of the detergent solution received ratings of 1 b. At detergent solution levels of 50 ptb the ratings varied from lb for three of the fuels to 2 for the remaining three. In addition, the demulsibility character of the detergent was determined using the following procedure. Iron Oxide powder (100 mg) and one drop of water are added in ml samples of unadditized and additized commercial gasoline, which are then thoroughly mixed. The amount of iron oxide left in suspension in each sample is measured at 0.5, 2.5 and 5.0 hours elapsed time. Repeatability of this procedure is estimated at approximately 2 mg. The tests, including the blank, were run with a second cycle, i.e., after the designated settling time and removal of a 25 ml. aliquot, 25 ml. fresh gasoline is replaced in the original sample which is then mixed and left standing for a second settling time and then retested. At detergent solution levels of 10 to 20 ptb no serious detraction in demulsibility is indicated by these tests as shown by the test results set forth in Table XII below.

TABLE XII

| Concentration of Detergent (ptb) | Cycle | Weight of Iron Oxide in Suspension (mg) 0.5 hours | 2.5 hours | 5.0 hours |
|---|---|---|---|---|
| none | 1 | 0.0 | 0.7 | 0.2 |
| none | 2 | 0.9 | 0.0 | 0.0 |
| 10 | 1 | 0.6 | 1.1 | 0.4 |
| 10 | 2 | 1.9 | 1.2 | 0.8 |
| 20 | 1 | 2.5 | 1.2 | 0.4 |
| 20 | 2 | 2.9 | 1.1 | 0.8 |

EXAMPLE 14

Material Compatibility Test

The detergent of the present invention has been shown to be compatible with a wide variety of materials that are used in the construction of both vehicles and commercial distribution systems. Using a detergent prepared as described in Example 3 above, at an extremely high level of 120 ptb concentration (60 ptb actives) in a commercial gasoline, additized and unadditized gasoline samples were compared in a test wherein material samples were submersed in individual test samples which were then held at 120° F. for a period of seven days. Following this period the samples were then evaluated on the basis of weight change and visual appearance. Using this test procedure no appreciable deterioration, as compared to the unadditized gasoline, was seen in the following materials when so tested in the 120 ptb detergent additized gasoline: Teflon, Buna-N, Viton O-Rings, Plasite 10-6000, Plasite 8-4300, Neoprene, Plexiglas, mild steel, aluminum, 304 SS, and 316 SS.

EXAMPLE 15

Induction System Deposit Effects

A detergent solution prepared as described in Example 3 above was evaluated in a bench scale Induction System Deposit Test to determine whether the detergent caused any significant deposit formation on engine components contacted subsequent to fuel delivery in an engine. At a detergent solution level of 60 ptb (30 ptb actives) in unleaded gasoline use of the detergent of the present invention was shown to result in an insignificant amount of deposit formation over the unadditized gasoline.

The dehazer may be combined with the alkenyl succinimide detergent composition in an amount up to about 10 weight percent based on alkenylsuccinimide, and preferably in an amount up to about 5 weight percent.

All percentages set forth herein are weight percentages unless expressly described as otherwise.

Commercial Applicability of the Invention

The present invention is applicable to the hydrocarbon fuel industry and all industries employing hydrocarbon fuels.

We claim:

1. A detergent for a hydrocarbon fuel composition comprising:

an alkenylsuccinimide prepared by reacting an alkenylsuccinic acid or anhydride with a mixture of amines, wherein at least 90 weight percent of the alkenyl substituent is derived from a olefin having a carbon chain of from 10 to 30 carbons or mixtures thereof, and wherein said mixture of amines is comprised of:

| Amine | Percentage by Weight |
|---|---|
| aminoethylethanolamine | 5 to 70 |
| aminoethylpiperazine | 5 to 30 |
| triethylenetetramine | 0 to 25 |
| hydroxyethylpiperazine | 0 to 20 |
| diethylenetriamine | 0 to 10 |
| higher oligomers of the above amines | 10 to 85 |

and wherein said alkenylsuccinic acid or anhydride is reacted with said mixture of amines at a mole ratio of 0.8 to 1.5 moles of said amines per mole of said alkenyl-succinic acid or anhydride.

2. The detergent of claim 1 wherein said olefin is a mixture of olefins at least 75 weight percent of which have chain lengths of from 12 to 26 carbon atoms.

3. The detergent of claim 1 wherein said mixture of olefins are at least 40 weight percent comprised of olefins having chain lengths of from 12 to 18 carbon atoms.

4. The detergent of claim 1 wherein at least 85 weight percent of said olefins have chain lengths of from 12 to 26 carbon atoms.

5. The detergent of claim 1 wherein at least 50 weight percent of said olefins have chain lengths of from 12 to 18 carbon atoms.

6. The detergent of claim 1 wherein said olefins length distribution:

| Chain Length | Weight Percentage |
|---|---|
| 10 carbons | 0 to 2.0 |
| 12 carbons | 0 to 25.0 |
| 14 carbons | 1.5 to 20 |

-continued

| Chain Length | Weight Percentage |
|---|---|
| 16 carbons | 15 to 30 |
| 18 carbons | 8 to 30 |
| 20 carbons | 6 to 15 |
| 22 carbons | 5 to 12 |
| 24 carbons | 5 to 12 |
| 26 carbons | 3 to 8 |
| 28 carbons | 2 to 5 |
| 30 carbons | 1.5 to 5 |
| greater than 30 carbons | 2 to 6 |

7. The detergent of claim 1 wherein said mixture of amines is comprised of:

| Amine | Percentage by Weight |
|---|---|
| aminoethylethanolamine | 15 to 50 |
| aminoethylpiperazine | 12 to 16 |
| triethylenetetramine | 2 to 10 |
| hydroxyethylpiperazine | 1 to 10 |
| diethylenetriamine | 0.5 to 3 |
| higher oligomers of the above amines | 25 to 45 |

8. The detergent of claim 1 further including up to 10 weight percent, based on said alkenylsuccinimide, of a polyglycolated alkyl phenol/formaldehyde resin type dehazer.

* * * * *

UNITED STATES PATENT AND TRADEMARK OFFICE

CERTIFICATE OF CORRECTION

PATENT NO. : 4,863,487

DATED : Sep. 5, 1989

INVENTOR(S) : George R. Meyer et al.

It is certified that error appears in the above-identified patent and that said Letters Patent is hereby corrected as shown below:

In Col. 1, line 7, after "gasoline" insert -- diesel --

In Col. 2, line 61, delete "1." and substitute therefor -- 18 --.

In Col. 4, line 61, delete "2.1" and substitute therefor -- 2:1 --.

In Col. 5, line 38, after " ("$C_{12-30}$ " insert -- olefin") --

In Col. 6, line 24, delete "$C_{12-}$18 " and substitute therefor -- $C_{12-18}$ --.

In Col. 6, line 62, delete "we.-e " and substitute therefor -- were --.

In Col. 7, line 2, delete "as" and substitute therefor --was--

In Col. 11, line 19, before " ml " add -- 100 --.

In Col. 12, line 62, Claim 6's 1st line, after " olefins " insert -- are substantially comprised of olefins of following chain --.

Signed and Sealed this

Second Day of October, 1990

*Attest:*

HARRY F. MANBECK, JR.

*Attesting Officer*

*Commissioner of Patents and Trademarks*